US008113161B2

(12) United States Patent
Gu et al.

(10) Patent No.: US 8,113,161 B2
(45) Date of Patent: Feb. 14, 2012

(54) MULTI-CAM ELECTRIC VALVE MECHANISM FOR ENGINE

(75) Inventors: Huan-Lung Gu, Hualien County (TW); Wen-Shu Jiaung, Miaoli County (TW); Shao-Yu Li, Hsinchu County (TW); Hui-Chun Ho, Hsinchu County (TW)

(73) Assignee: Industrial Technology Research Institute, Hsin-Chu (TW)

( * ) Notice: Subject to any disclaimer, the term of this patent is extended or adjusted under 35 U.S.C. 154(b) by 580 days.

(21) Appl. No.: 12/357,054

(22) Filed: Jan. 21, 2009

(65) Prior Publication Data

US 2010/0108002 A1 May 6, 2010

(30) Foreign Application Priority Data

Nov. 4, 2008 (TW) ..... 97142459 A

(51) Int. Cl.
*F01L 1/18* (2006.01)

(52) U.S. Cl. ..... 123/90.25; 123/90.24; 123/90.16

(58) Field of Classification Search ..... 123/90.11, 123/90.15, 90.16, 90.24, 90.25
See application file for complete search history.

(56) References Cited

U.S. PATENT DOCUMENTS 4,455,543 A 6/1984 Pischinger et al.
5,873,335 A * 2/1999 Wright et al. ..... 123/90.11
6,755,166 B2 6/2004 Chang et al.

* cited by examiner

*Primary Examiner* — Zelalem Eshete
(74) *Attorney, Agent, or Firm* — WPAT., P.C.; Justin King

(57) ABSTRACT

A multi-cam electric valve mechanism for engine is disclosed, which comprises: a motor fixed on a cylinder; a motor shaft wherein one side of it connected to the motor and rotated accordingly and the other side of it symmetrically provided with a plurality of rotors whose shafts are perpendicular to the motor shaft; a ring-shaped cam with a plurality of wave-shaped grooves on the circumference thereof corresponding to the rotors and for setting same; a rotation-stopping lever connected to the cylinder and cam respectively to let the cam linearly move along with it; and a valve lever wherein one side of it connected to the cam and the other side of it connected to a valve.

35 Claims, 12 Drawing Sheets

MULTI-CAM ELECTRIC VALVE MECHANISM FOR ENGINE

FIELD OF THE INVENTION

The present invention relates to an engine valve mechanism, and more particularly, to a multi-cam electric valve mechanism for engines.

BACKGROUND OF THE INVENTION

In the technical field of the internal combustion engine, there has heretofore been well known a system for controlling variably the operation timing for at least one of an intake valve and an exhaust valve of the engine in dependence on the operation state thereof with a view to enhancing efficiency of intake and discharge operations of the engine cylinders. In most internal combustion engines, the engine cylinder intake and exhaust valves are opened and closed by cams which are driven to rotate by camshafts powered by crankshaft of an engine in a pure mechanical manner. As the engine performance is highly affected by the operation parameters of its intake and exhaust valves regarding to their opening and closing, there are already many valve control mechanisms been developed for fabricating a better engine In many such technically advanced engines current available on the market, it is common to use a computer to control and vary the open/close timing of the intake/exhaust valves for allowing the same to match the performance of the engine at different loads and speeds by that the output and fuel economy of the engine can be improved. Such variable valve control system is often be addressed as the intelligent valve control system, and moreover, when the valves in such intelligent valve control system are opened and closed and held open or closed by means of electromagnets, the system can be addressed as the electrical valve control system.

The aforesaid intelligent valve control system has many advantages as it is designed to control the opening duration of each and every intake valves and exhaust valves independently and respectively, by that it can be programmed by artificial intelligence for varying the valve opening duration to match an engine's rotational speed and thus improving the power output as well as the fuel efficiency of the engine. When an intelligent valve control system is applied in an engine, the optimum timing regarding to the opening and closing of each intake/exhaust valves can be obtained for allowing optimun engine performance at different loads and speeds. Operationally, it can prompt the intake valves and the exhaust valves to be opened completely at the instant when the engine is being ignited regardless the customary timing of the intake/exhaust valves, by that as the air in the cylinder of the engine will not be compressed, not only it can facilitate the RPM of the engine to be raised rapidly and thus the engine can be started without causing the starter motor to exhaust too much electricity, but also it can prolong the lifespan of the starter motor especially when the vehicle using the engine is in stop-and-go traffic constantly. Moreover, when the intelligent valve control system is applied in a multi-cylinder engine, it can command some of the cylinders to be deactivated when they are not needed according to the operation condition of the engine, by that the intake valves and exhaust valves of those deactivated cylinders are closed completely regardless their customary timing so as to prohibit air from flowing in and out of those deactivated cylinders and thus enhance the engine efficiency. In addition, when it is applied in a multi-cam engine, i.e. an engine that have more than two intake valves in each cylinder, and the engine is operating in a low load/load RPM condition, the intelligent valve control system will enable only one intake valve for each cylinder in the engine while disabling the others by directing those other valves to be closed completely, so that the fuel consumption of the engine can be reduced as the intake efficiency for the engine in the low load/load RPM condition is enhanced. As the electrical valve control system use solenoid valves or electric motors to control the opening and closing of the intake/exhaust valves, the open/close timing of the intake/exhaust valves are easier to be varied comparing with those conventional mechanical-driven intake/exhaust valves which is suitable to be applied in various engines for optimizing the performance of the same.

There are already many intelligent electrical valve control system currently available. One of which is an actuation system using solenoid valves for valve control disclosed in U.S. Pat. No. 4,455,543, entitled "Electromagnetically operating actuator". The aforesaid actuation system is characterized in a double-acting spring module configured therein as it is composed of two springs in a manner that when one of the two springs is being pulled, the other is being compressed, and vice versa. Since it is achievable to obtain the optimal resonant effect in the mass-spring system formed by the engagement of the double-acting spring module and the valves to be controlled, not only the response speed can be enhanced, but also the energy loss is decreased. However, there are still some problems which may be encountered with this electromagnetic methodology of using solenoid valves for valve control. For instance, as the solenoid valve uses magnet to attract its corresponding valves while resisting the resilence of the spring module, not only the resulting mechanical response is slower, but also it will consume more electricity than electric motor, so that it has poor feasibility.

Another such electrical valve actuation mechanism, which use an electric motor for valve control, is disclosed in U.S. Pat. No. 6,755,166, entitled "Electromechanical valve drive incorporating a nonlinear mechanical transformer". The aforesaid mechanism not only has the benefit of the foregoing double-acting spring module, but also is able to control the valves to move in a non-linear trajectory by the use of a cam mechanism and thus can drive the valves to move as fast as possible without too much variation in acceleration. Thereby, the valves can be opened or closed to their maximum rapidly without bumping on the valve seats and thus causing loud noise, and therefore can maintain the maximum opening or closing for a comparatively longer duration so as to increase the total air flux per unit time that is flowing through the intake/exhaust valves. In addition, as the aforesaid mechanism is able to enable a rotation movement by the cooperation of the reciprocating electric motor and the oscillating double-acting spring module, the valves can be driven to move much faster while consuming less energy. As the reciprocating electric motor is different from the conventional rotary electric motor in that: the magnet filed in the reciprocating electric motor is not necessary to be distributed equiangularly, and also the reciprocating electric motor is not necessary to be shaped as a cylinder as it can be shaped like a semicircular cylinder or a cuboid whichever can be easier disposed in the narrow space available on the cylinder head of the engine.

Nevertheless, the foregoing conventional mechanisms still has the following disadvantages: (1) As the nonlinear mechanical transformer used in the cam mechanism for causing the valve to move in a nonlinear trajectory will exert a single-directional sidewise push force on the valve levers, the valve levers can be skewed or can be overly rubbed on a portion thereof; (2) As the valves are one-stage valves that being driven by a double-acting spring module, there will be two springs working on opposite directions that are engaged with a same valve lever simultaneously and therefore, the valves being driven to close can not tightly fit on the valve seats since the force propelling the valve to raise is larger than the force dragging the valve to fit on the valve seat.

SUMMARY OF THE INVENTION

In an exemplary embodiment, the present invention provides a multi-cam electric valve mechanism for engine, which comprises: a motor, fixed on a cylinder; a motor shaft, being connected to the motor by an end thereof for enabling the same to be driven to rotate accordingly while having a plurality of rotors being symmetrically distributed around another end thereof in a manner that the shaft of each rotor is oriented perpendicular to the motor shaft; a ring-shaped cam, formed with a plurality of wave-shaped grooves on the circumference thereof at positions corresponding to the plural rotors for receiving the same; a rotation-stopping lever, connected to the cylinder and the cam respectively for allowing the cam to move linearly along with the rotation-stopping lever; and a valve lever, having an end thereof connected to the cam and another end thereof connected to a valve.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
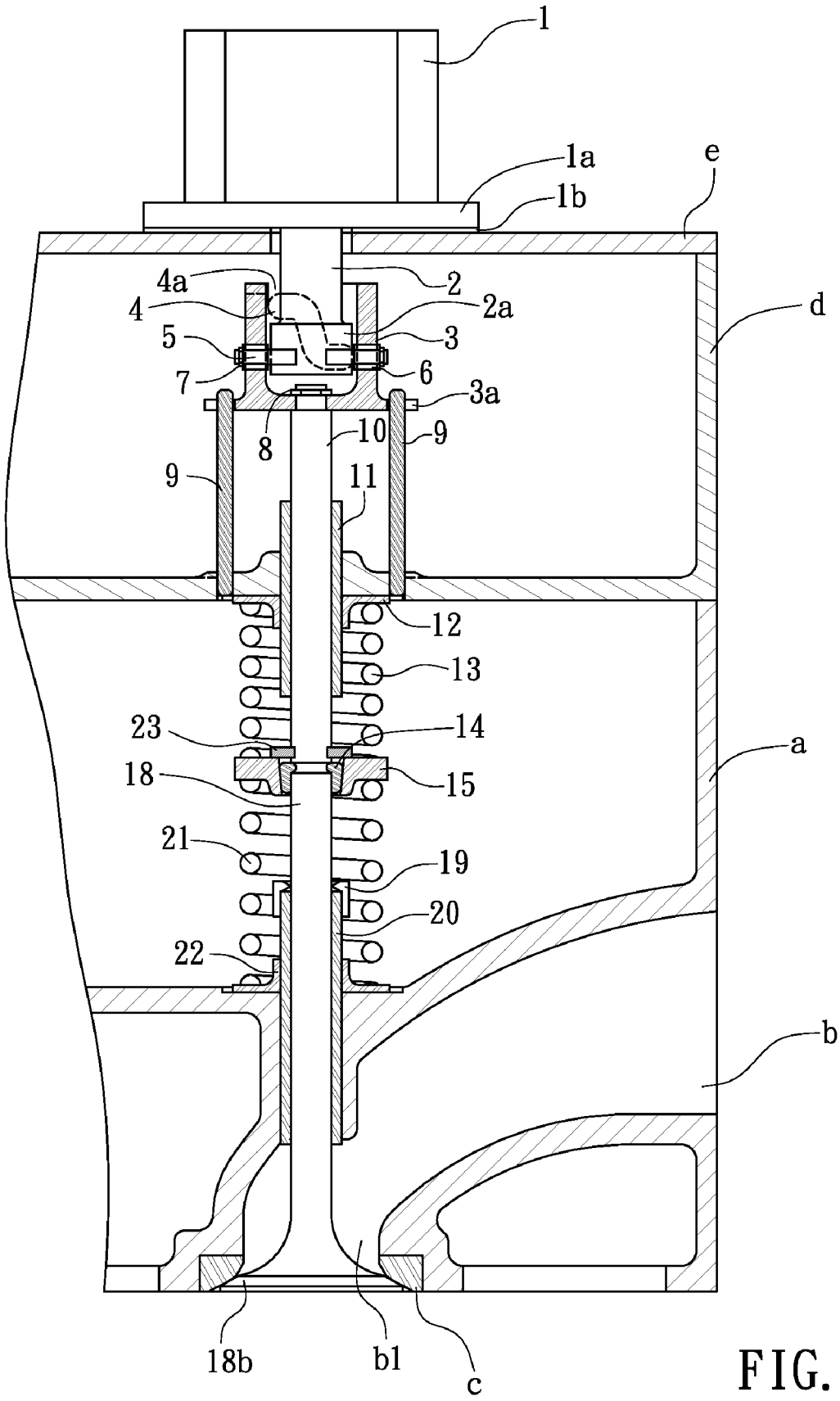
FIG. 1 is a sectional view of a valve in a multi-cam electric valve mechanism according to a first embodiment of the present invention as it is closed.

Please refer to FIG. 1, which is a sectional view of a valve in a multi-cam electric valve mechanism according to a first embodiment of the present invention as it is closed. In FIG. 1, the valve 18*b* is integrated with the valve stem 18 as one rod without being separated, in which the valve 18*b* is disposed at a position in the neighborhood of an air duct's b opening b1 that is formed on the cylinder head a so as to be used for closing the valve seat c; and the valve stem 18 is connected to an upper lever 10 by an end thereof that is not connected to the valve 18*b*, and is received inside the valve guide 20 that is tightly fitting in the cylinder head a for allowing the valve stem 18 to slide therein. There is an oil seal 19 disposed on the top of the valve guide 20 for preventing the lubricant oil from leaking into the air duct b from the valve stem 18. In addition, the upper lever 10 is received inside a valve lever guide 11 for allowing the same to slide therein, whereas the valve lever guide is tightly fitted in the upper portion d of the cylinder head a. As shown in FIG. 1, there is a spring fixing seat 15 being disposed at a position corresponding to the joint of the valve stem 18 and the upper lever 10, which is used for restricting the movement of an upper spring 13 and a lower spring 21 inside the cylinder head a as the upper spring 13 and the lower spring 21 are coaxially mounted on the upper lever 10 and the valve stem 18 in respective. Moreover, the upper spring 13 and the lower spring 21 are disposed inside a space sandwiched between an upper spring base 12 and a lower spring base 22 in manner that the two spring bases 12, 22 are positioned to sustain the stress from the upper spring 13 and the lower spring 21 in respective. The spring fixing seat 15 is fixedly secured to the valve stem 18 by the use of a snap key 14 and a snap ring 23, by that the spring fixing seat 15 can be actuated in synchronization with the valve stem 18 and thus cause the upper spring 13 and the lower spring 21 to function opposite to each other with respect to the valve stem 18 since when the upper spring 18 is being compressed, the lower spring is being pulled and vice versa. The upper lever 10 is disposed entering the top portion d of the cylinder head a where it is connected to a cam 3 by a snap ring 8, by that the valve stem 18 can be brought to move in synchronization with the movement of the cam 3. There are at least two grooves 4 equiangularly formed on the circumference of the cam 3 that each of the groove 4 is designed for receiving a rotor 6 while allowing the rotor 6 to slide and rotate therein. Each rotor 6 is fixed on an end of a tappet 5 by a snap ring 7 while allowing the same to rotate thereon; and the other end of the tappet 5 is fixedly secured on a tappet seat 2*a* as the tappet seat 2*a* is connected to the motor shaft 1 which is driven by an electric motor 1.

When the electric motor 1 is activated to work according to the control of a time function, the rotating motor shaft 2 will cause the rotors 6 to rotate and move inside their corresponding grooves 4 and thus cause a pressing force on the cam 3. However, as there are rotation-stopping slots 3*a* formed evenly on the cam 3, the cam 3 is limited only able to move up and down without rotating as the rotation-stopping slots 3*a* is wedged and fixed by the rotation-stopping levers 9 formed on the top portion d of the cylinder head a. That is, the cam 3 will be guided by the wave-shaped groove 4 to move in an undulating manner according to the time function, by which a timing function of valve lift controlling the on/off of the valve 18*b* is defined. As the upper spring 13 and the lower spring 21 are designed function opposite to each other, it is considered as a special mass-spring system that functions to reduce the force required for activating the valve 18*b* to move. In addition, as at any time no matter the valve is moving upward or downward, there is a spring in the mass-spring system that is situated for releasing its potential energy by that the response speed of the whole valve system can be greatly enhanced. Thereby, not only the performance of an engine can be greatly improved when it is operating in high rotation speed, but also when the engine is operating in low rotation speed the exhausting efficiency of the engine is greatly improved as the valve 18*b* is enabled to achieve its maximum lift in a much less time. That is, the performance of the engine is improved in every rotation speed.

As shown in FIG. 1, the electric motor 1 is fixedly mounted on the upper cap e of the cylinder head a by a flange 1*a*; and there is an opening 4*a* formed on top of each groove 4 to be used for assembly. Moreover, each rotor 6 along with its tappet 5 are first being fixedly mounted on the motor shaft 2 of the electric motor 1, and then the rotor 4 is inset into the cam 3 through the opening 4*a* while allowing the rotor 6 to slide and rotate inside the groove 4. As each rotor is able to slide and rotate inside its corresponding groove 4, the stress that each rotor 6 is exerting on its corresponding groove 4 is perpendicular to the surface of the groove 4 and the stress can be broken into two component forces. One of the two component forces is parallel to the axial direction of the upper lever 10 or valve stem 18 for causing the same to move reciprocatively in the axial direction. However, since such parallel component force is not align with the axis of the upper lever 10 or valve stem 18 and if there is there is only one rotor 6 and one corresponding groove 4, there will be an unfavorable torque being generated that will push the upper lever to press on the valve lever guide 11 for causing undesirable wear and tear thereon. Therefore, there are a plural pair of rotor and groove that are equiangularly arranged for balancing out the torques resulting thereby and thus facilitating the reciprocating movement of the valve stem 18. Moreover, another such component force is perpendicular to the axial direction of the upper lever 10 or valve stem 18 which is also not align with the axis of the upper lever 10 or valve stem 18, so that the torque resulting from the aforesaid component force will cause the cam 3 to revolve around the axis of the upper lever 10 or valve stem 18. Nevertheless, as the rotating cam 3 will be blocked by the rotation-stopping lever 9 arranged at the top portion d of the cylinder head a, such revolving torque is resisting thereby for preventing the cam 3 from rotating.

Figure 2:
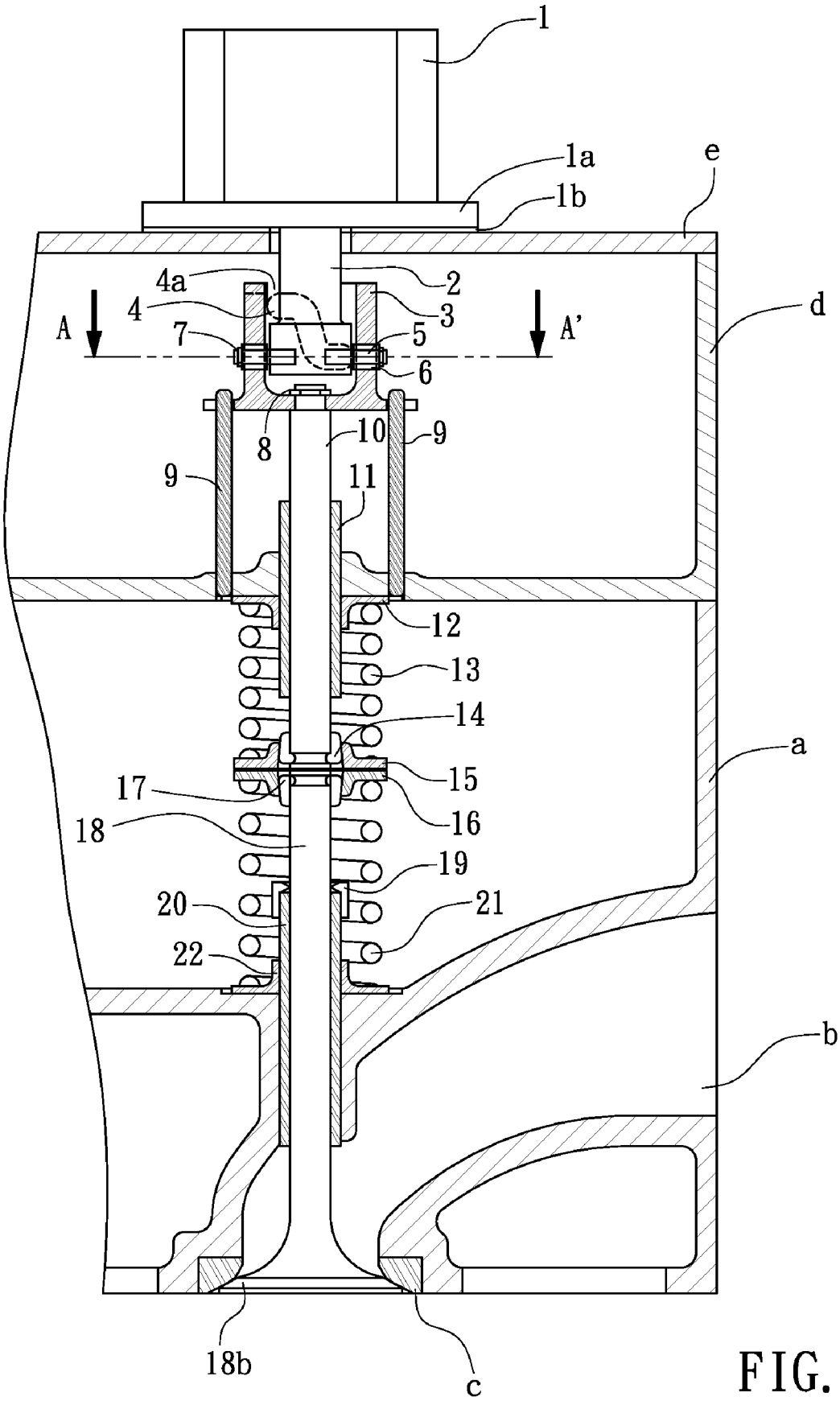
FIG. 2 is a sectional view of a valve in a multi-cam electric valve mechanism according to a second embodiment of the present invention as it is closed.

Please refer to FIG. 2, which is a sectional view of a valve in a multi-cam electric valve mechanism according to a second embodiment of the present invention as it is closed. The difference between the first embodiment of FIG. 1 and the second embodiment is that: the upper lever 10 and a valve stem 18 of FIG. 2 is not integrated into one valve lever that it is separated into two rods, i.e. an upper lever 10 and a valve stem 18. In FIG. 2, an upper spring 13 is secured on the upper lever 10 by the use of a spring fixing seat 15 and a snap key 14 while a lower spring 21 is similarly secured to the valve stem 18 by the use of another spring fixing seat 16 and snap key 17. When the upper lever 10 is lift to the maximum by the cam 3, there is still a gap existed between the upper lever 10 and the valve stem 18. Except for the aforesaid difference, all the other components in the second embodiment of FIG. 2 are the same as those shown in the first embodiment of FIG. 1 which will not be described further hereinafter.

It is required to have the gap formed between the upper lever 10 and the valve stem 18 when the upper lever 10 is lifted to its maximum. Moreover, the size of the gap can be adjusted by the use of adjusting pads for optimizing the same to match with machining tolerance. When the upper lever 10 and the valve stem 18 are separated by a proper gap, not only the influence of the inevitable machining tolerance can be minimized, but also when the upper lever is lifted to its maximum for closing the valve and thus the movement of the upper lever 10 is stopped, the gap formed between the upper lever 10 and the valve stem 18 can function for preventing the movement of the valve stem 10 from being obstructed by the stopped upper lever 10, by that the valve stem 18 can be pull by the lower spring 21 without any obstruction so as to tightly close the valve 18*b* on valve seat c.

Figure 3:
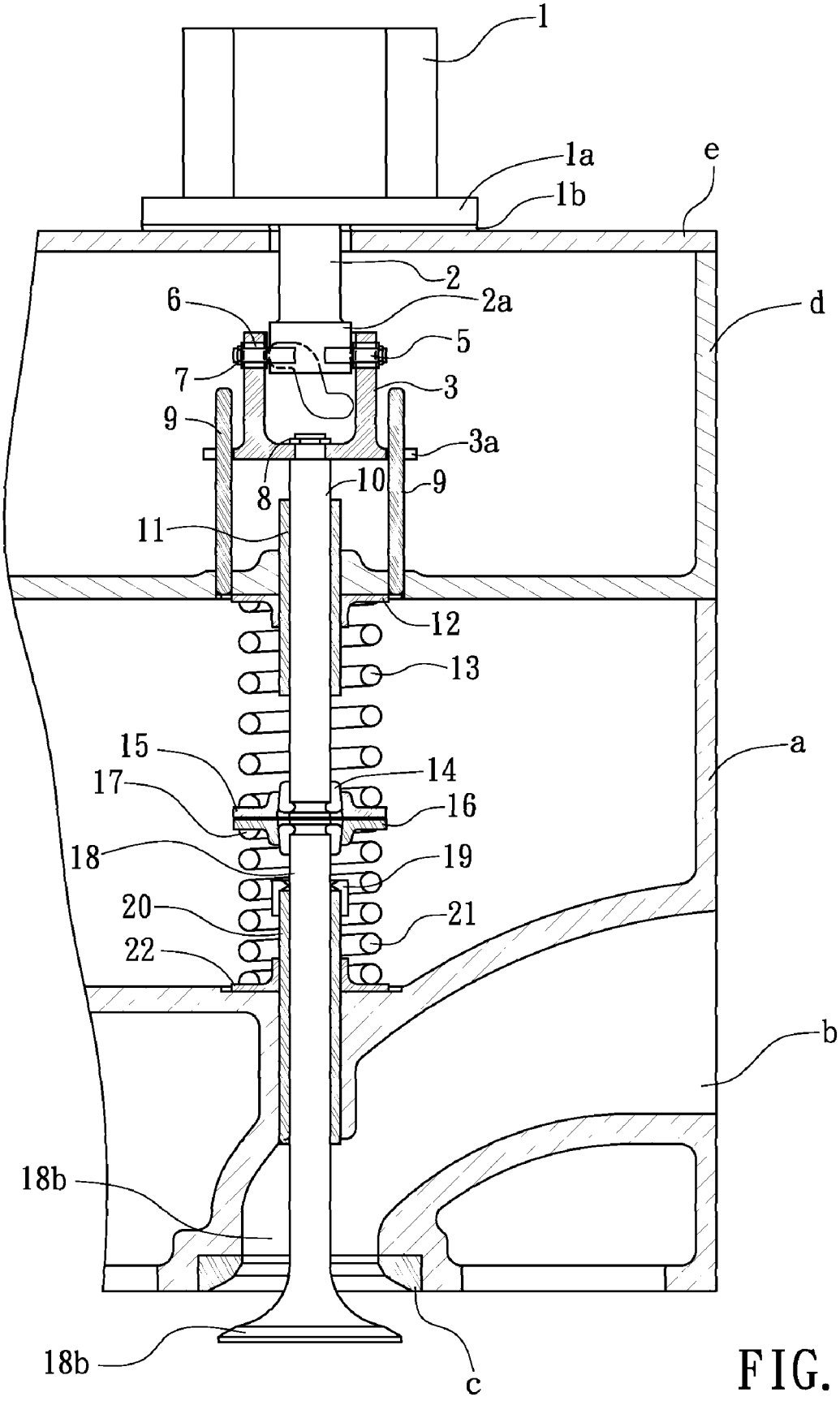
FIG. 3 is a sectional view of a valve in a multi-cam electric valve mechanism according to a second embodiment of the present invention as it is opened.

After achieving the maximum position, the rotation of the motor shaft 2 driven by the electric motor 1 will bring along the tappet seats 2*a* and the rotors to rotate accordingly and thus force the cam 3 being blocked by the rotation-stopping lever 9 to move downwardly following the guidance of the groove 4 for bringing along the upper lever 10 to move downward. Thereby, the downward-moving upper lever 10 will press on the valve stem 18 so as to bring the valve 18*b* to also move downward and thus open the valve seat c, as shown in FIG. 3.

Figure 4:
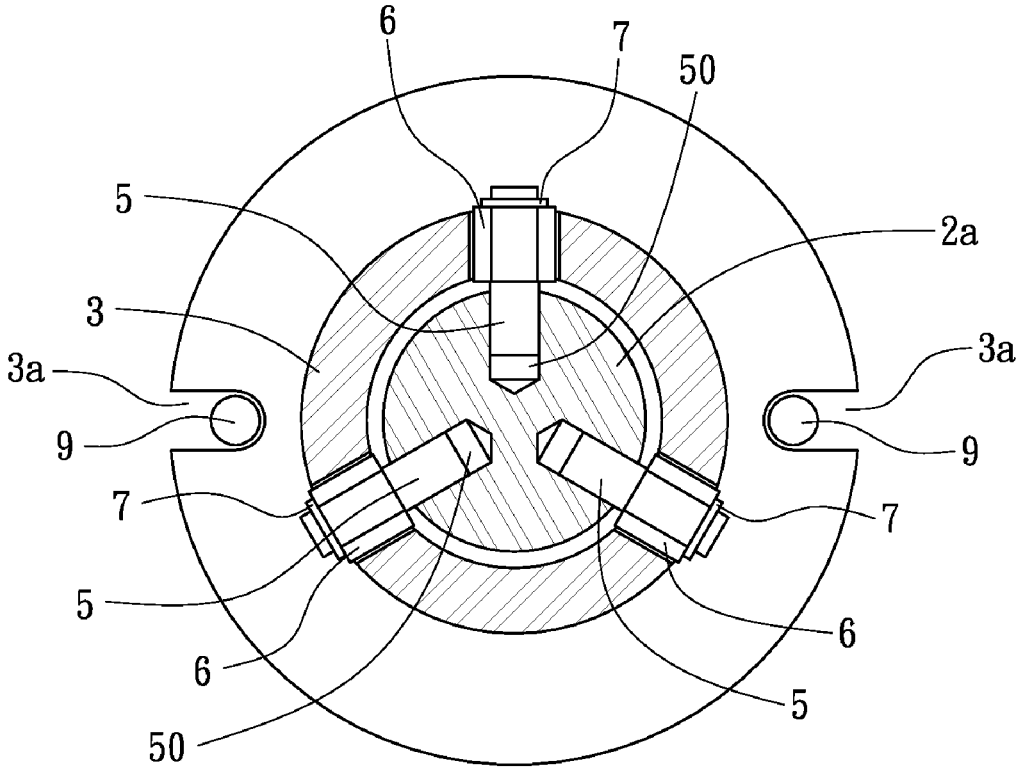
FIG. 4 is an A-A' cross sectional view of FIG. 2.

Please refer to FIG. 4, which is an A-A' cross sectional view of FIG. 2. In FIG. 4, there are three sets of rotor 6, tappet 5 and snap ring 7 that are equiangularly arranged on a tappet seat 2*a*. As each tappet 5 is tightly fitted inside its corresponding supporting hole 50, the tappets 5 can be driven to rotate in synchronization with the rotation of the tappet seat 2*a*. Forces resulting from the movement of the rotors 6 are distributed evenly around the circumference of the cam 3 while the cam 3 is designed to be blocked by the rotation-stopping lever 9 fitted in a rotation-stopping slot 3*a* so that the cam 3 is prevented from rotating.

Figure 5:
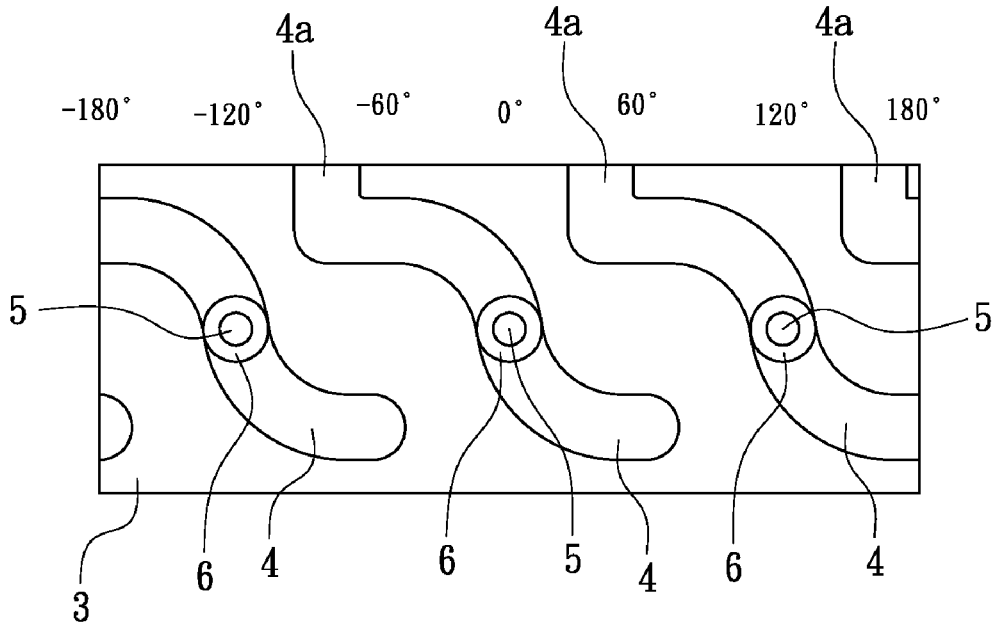
FIG. 5 is a side view of the cam depicted in FIG. 4.

Please refer to FIG. 5, which is a side view of the cam depicted in FIG. 4. In FIG. 5, the three rotors 6 are fitted in their corresponding grooves 4 while the grooves are equiangularly distributed on the cam 3. There is an opening 4*a* formed on the end of each groove 4 so as to be used for the corresponding rotors 6 to sliding into the grooves 6 therefrom and thereby inset in the cam 3 after the rotors 6 are assembled with the tappets 5 and the tappet seats 2*a*. By the aforesaid configuration, it can prevent the valve lever to receive a single-directional sidewise push force as the pushing forces exerted on the lever axis from the three rotors 6 are symmetrically and evenly distributed with respect to the axis of the valve lever.

Figure 6:
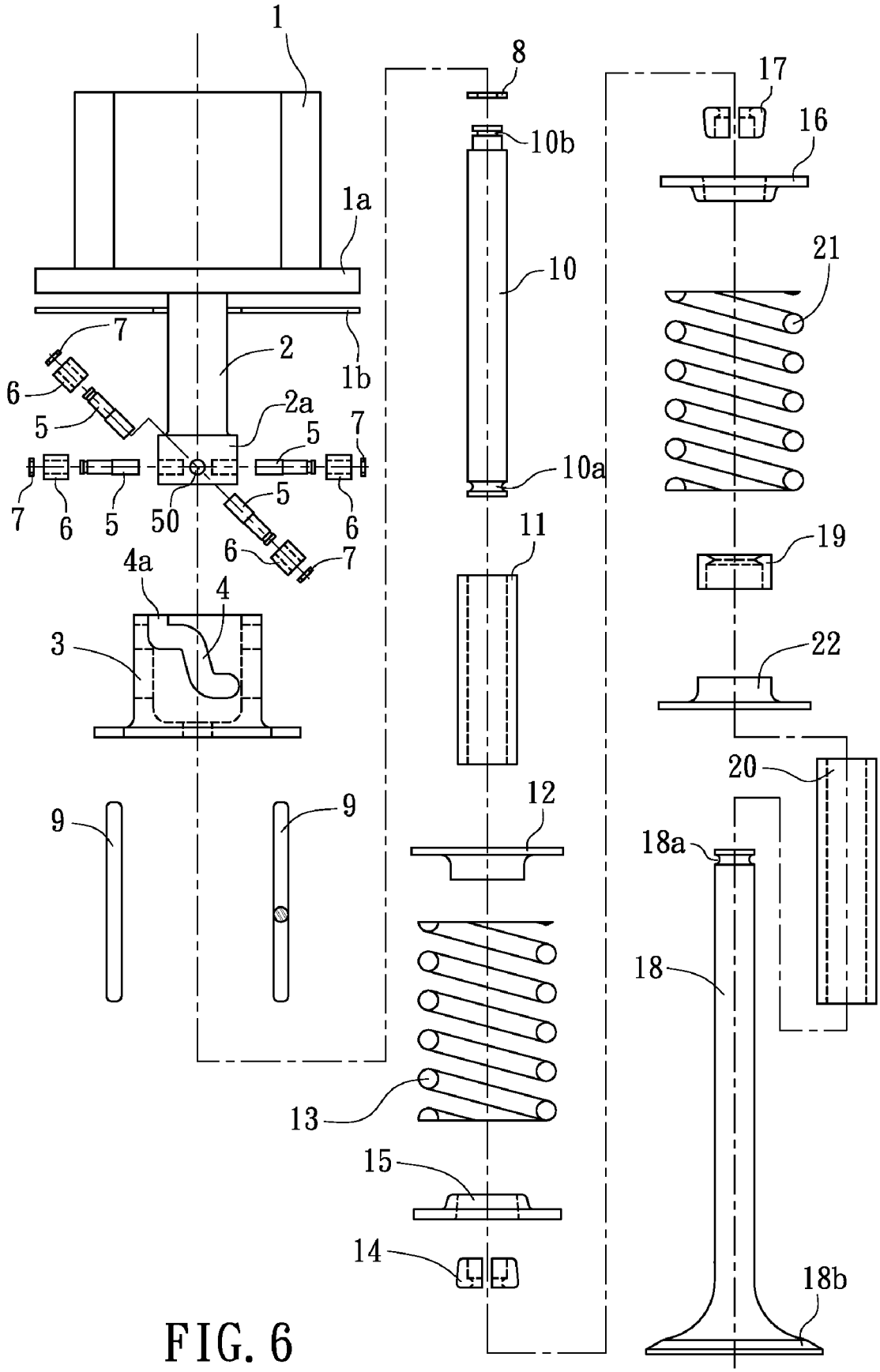
FIG. 6 is an exploded view of the second embodiment of the present invention.

Please refer to FIG. 6, which is an exploded view of the second embodiment of the present invention. There is a snap ring slot 10*b* formed on the upper portion of the upper lever 10 that is provided for the snap ring 8 to inset therein and thus fixedly securing the upper lever 10 to the cam 3. Moreover, there is a snap key slot 10*a* formed on the lower portion of the upper lever 10 that is provided for the snap key 14 to inset therein and thus enabling the resilience of the upper spring 13 to be transmitted to the upper lever 10 through the spring fixing seat 15. Similarly, there is a snap key slot 18*a* formed on the upper portion of the valve stem 18 that is provided for the snap key 17 to inset therein and thus enabling the resilience of the lower spring 21 to be transmitted to the valve stem 18 through the spring fixing seat 16.

Figure 7:
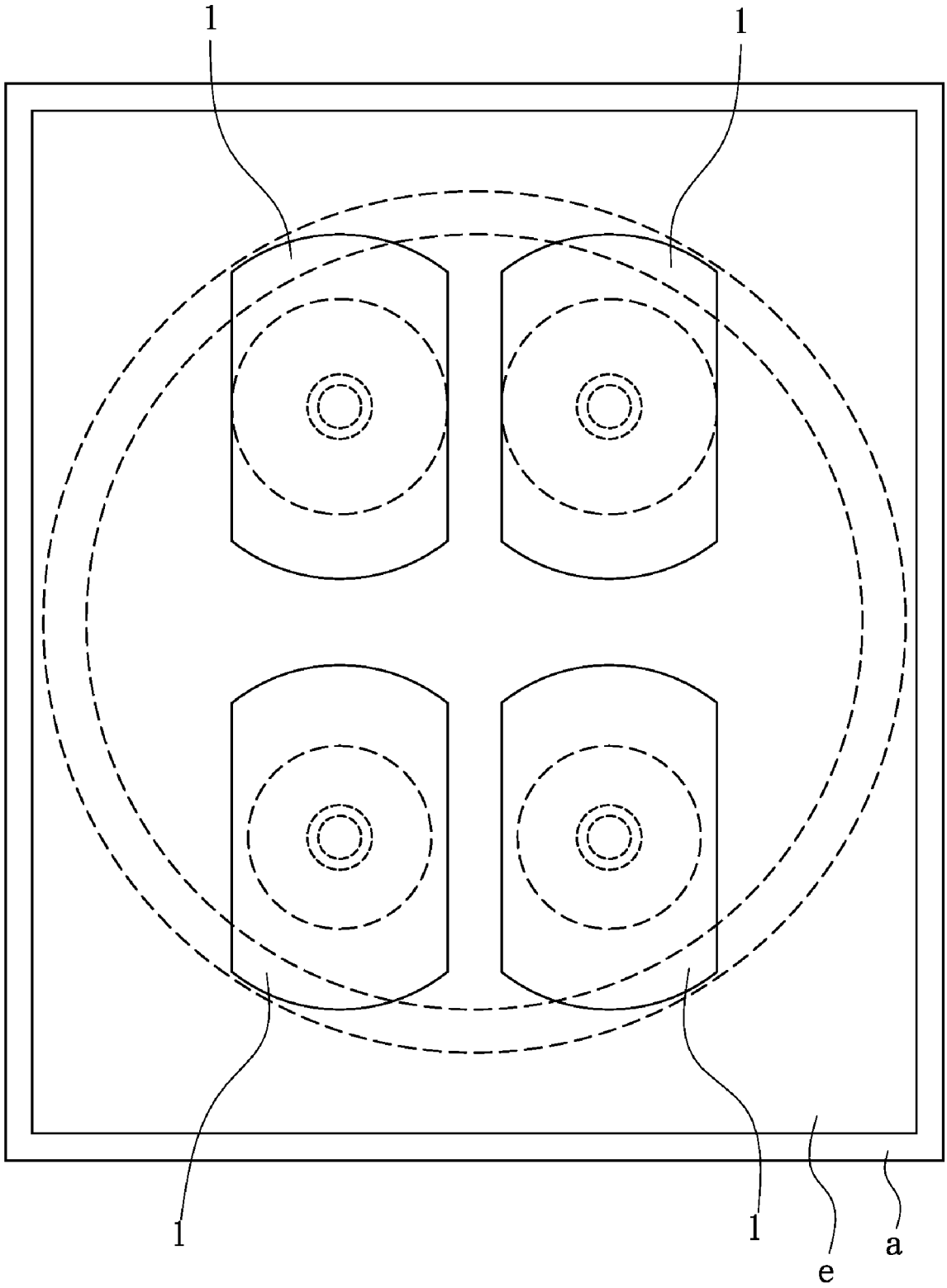
FIG. 7 is a schematic diagram showing how a reciprocating is disposed on a cylinder head according to the present invention.

Please refer to FIG. 7, which is a schematic diagram showing how a reciprocating is disposed on a cylinder head according to the present invention. As the reciprocating motor is characterized in that: the coil used in the reciprocating motor is not necessary to be a circular coil, it can be control electrically to produce a reciprocating motion at any angle so that it is suitable to be used as the power unit of the invention. Operationally, the reciprocating motors 1 are mounted on the cylinder head that are coaxial with their corresponding valves. For those multi-valve engines as the one shown in FIG. 7, the distance between the two intake valves or the two exhaust valves is very small so that there is only a limited space provided for the electric motor to be disposed and thus the reciprocating motor with flat coil configuration is preferred.

Figure 8:
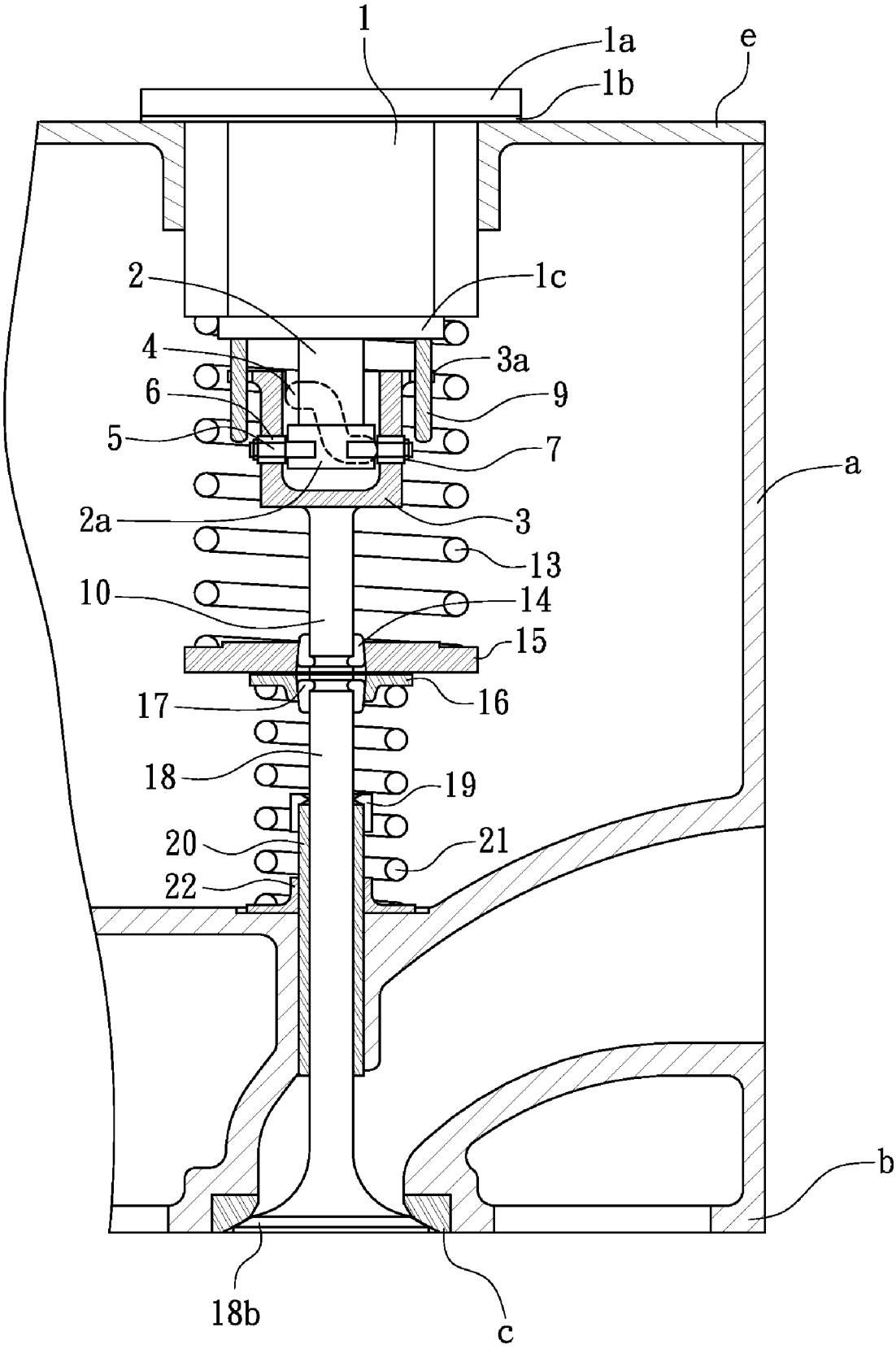
FIG. 8 is a sectional view of a valve in a multi-cam electric valve mechanism according to a third embodiment of the present invention as it is closed.

Please refer to FIG. 8, which is a sectional view of a valve in a multi-cam electric valve mechanism according to a third embodiment of the present invention as it is closed. In this embodiment, in order to prevent the cylinder head from being divided into two sections and the same time to minimize the amount of parts required for fabricating the cylinder while facilitating the assembly of the same, the multi-cam electric valve mechanism of the embodiment is deformed as well as extended. As shown in FIG. 8, there is a spring support 1*c* integrally formed at the bottom of the motor 1 that is used for replacing the function of the upper spring base 12. The structure of the top portion d of the cylinder head a in the first embodiment is omitted from the present embodiment. The upper lever 10 along with the cam 3 that are mounted on the motor shaft 2 are tightly secured to the spring support 1*c* of the motor 1 by the spring fixing seat 15 and the snap key 14. The rotation-stopping lever 9 is fixed to the motor 1 in a manner that it can be inset into the rotation-stopping slot 3*a* so as to only allow the cam to move up and down while preventing the same from rotating. Although it is not shown in FIG. 8, there is a gap formed between the upper lever 10 and the valve stem 18 when the valve 18*b* is closed, and thereby, the whole mechanism can be divided into two sub-mechanisms, i.e. a top sub-mechanism and a bottom sub-mechanism. The motor 1 can be designed to rotate in a single directional rotation, in a stepwise manner, or in clockwise and anticlockwise manner, but it is preferred to be a dual-directional reciprocating motor. The cam 3 and other structures on the top sub-mechanism are ensheathed by the upper spring 13. For enabling the upper spring 13 and the lower spring 21 to have the same elastic coefficient, the parameters relating to the two springs 13, 21, such as the coil number, can be different. In view of the assembly, the aforesaid mechanism is advantaged in that: as the lower spring 21 along with the valve stem 18 are fixedly secured inside the cylinder head a by the use of the spring fixing seat 16 and the snap key 17, and the parts including the cam 3, the tappets 5 the rotors 6, the upper lever 10 and the upper spring 13 are tightly installed on the motor 1 in a manner that the entire top sub-mechanism can be considered as a complete assembled part, the gap formed between the valve stem 18 and the upper lever 10 can be adjust by the use of an adjusting pad 1*b* for optimizing the same; and then, the whole mechanism can be mounted on top of the cylinder head a by connecting the flange 1*a* of the motor 1 to the cylinder cap e.

Figure 9:
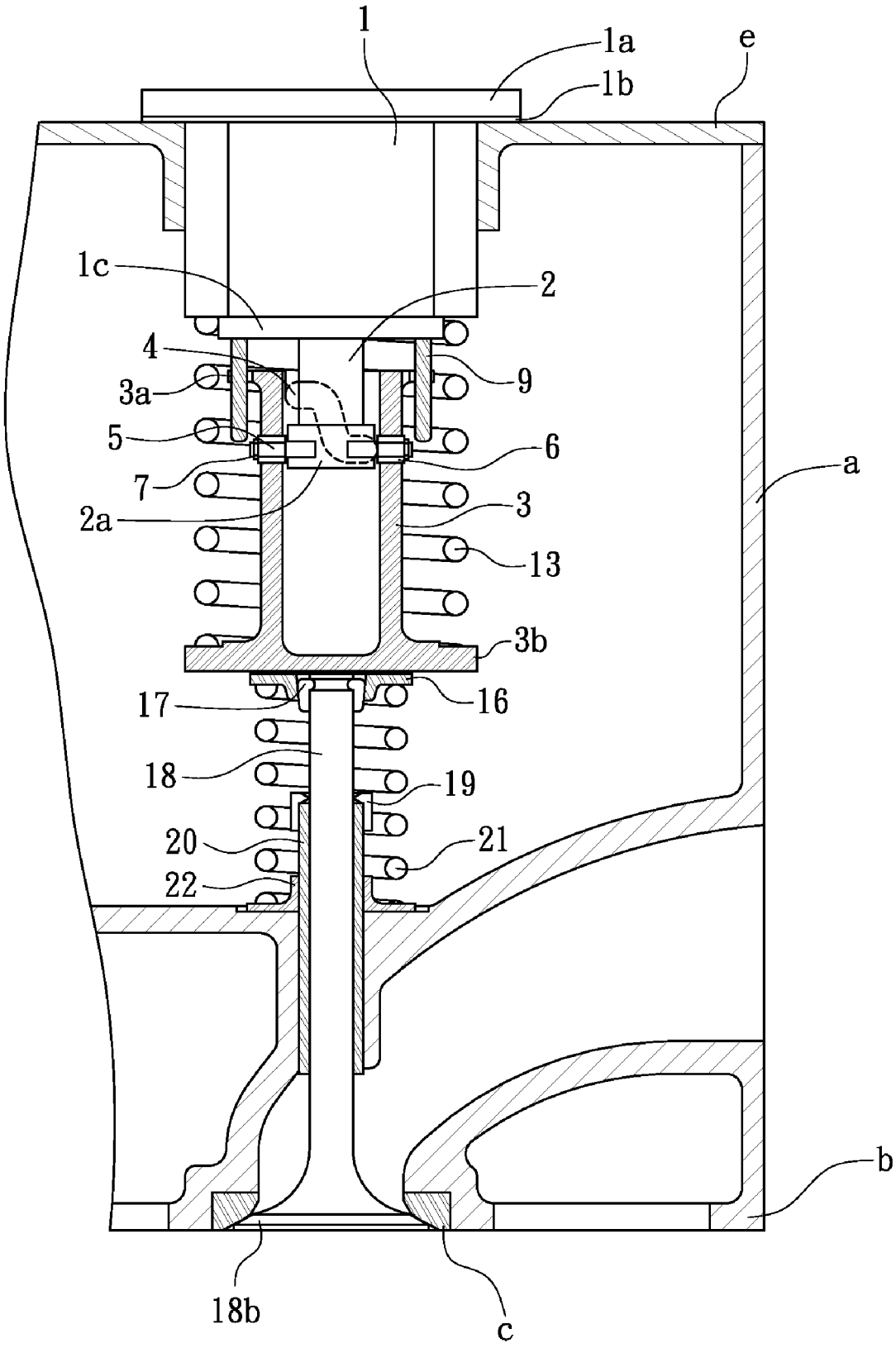
FIG. 9 is a sectional view of a valve in a multi-cam electric valve mechanism according to a fourth embodiment of the present invention as it is closed.

Please refer to FIG. 9, which is a sectional view of a valve in a multi-cam electric valve mechanism according to a fourth embodiment of the present invention as it is closed. The fourth embodiment is the deformation of the third embodiment. In this embodiment, the snap key 14 and the spring fixing seat 15 are omitted, and the upper lever 10 is integrally formed with the cam 3 while forming a spring base 3*b* at the bottom of the cam 3 to be used for supporting the upper spring 13. In addition, the cam 3 is formed with a plurality of grooves 4 whereas each groove 4 is provided for a corresponding rotor 6 mounted on the motor shaft 2 to inset therein; and as the cam 3 is blocked by a rotation-stopping lever 9, it is prevented from rotating and thus it will not detached from the motor shaft 2 during assembly. It is noted that the outer diameter of the spring support 1*c* should be large enough comparing to the inner diameter of the upper spring 13 so that the upper spring 13 can lock on tightly to the spring support 1*c* by wedging the spring support 1*c* into the upper spring 13. Finally, similar to the third embodiment, the parts including the motor 1, the cam 3 and the upper spring 13, etc., are assembled as a complete assembled part, and then the assembled part is installed on the cylinder cap e, by that the amount of parts is reduced and the assembly process is simplified.

Figure 10:
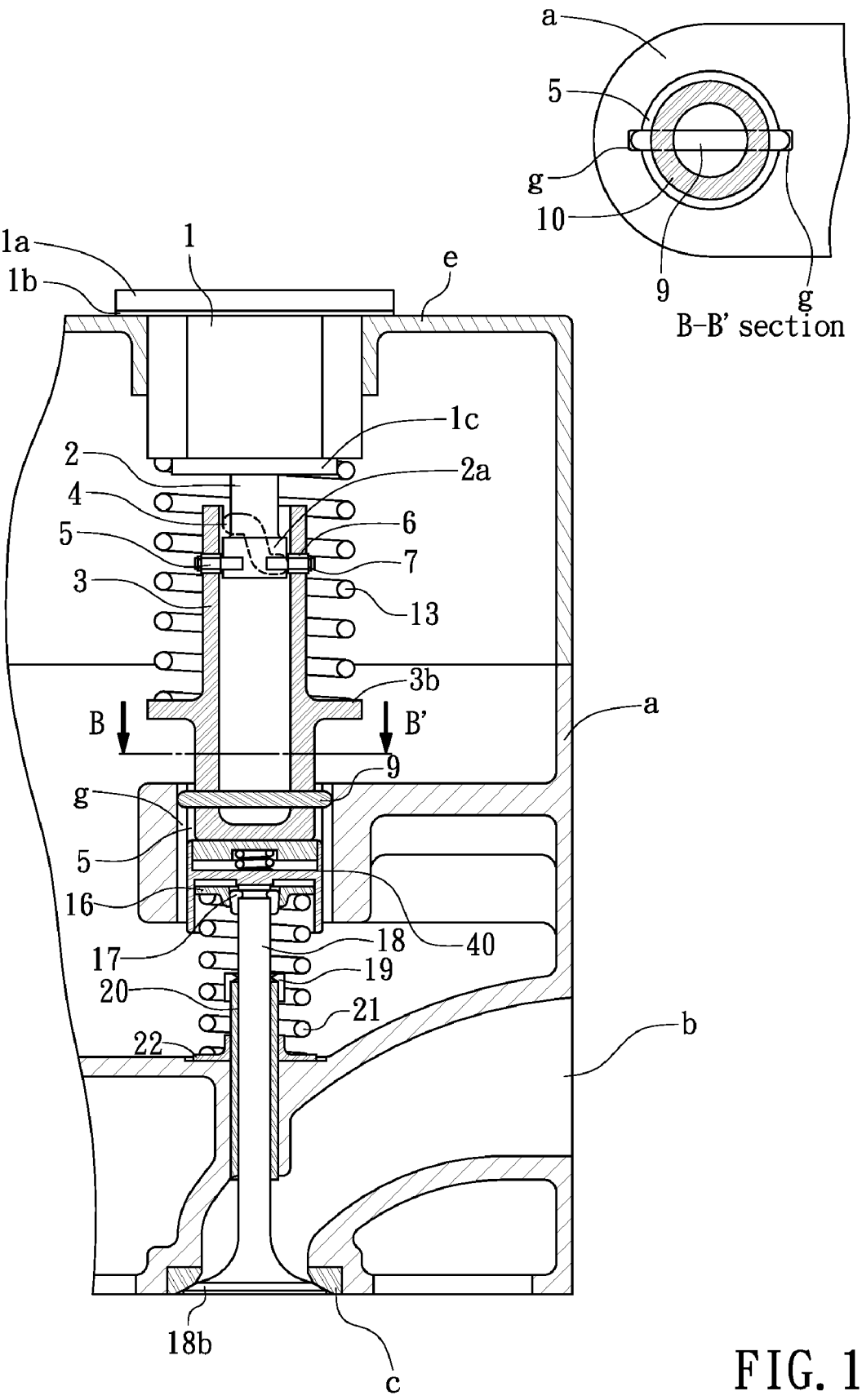
FIG. 10 is a sectional view of a valve in a multi-cam electric valve mechanism according to a fifth embodiment of the present invention as it is closed.

It is noted that for same conventional engines, there are already level holes preformed on their cylinder head a. The multi-cam electric valve mechanism of the invention can be modified for adapting the same to such engines, as the fifth embodiment shown in FIG. 10. In FIG. 10, the bottom of the spring seat 3*b* elongated to be used for acting as the upper lever 10 of FIG. 9, and thus the elongated portion is slidably disposed inside the lever hole f of the cylinder head a while enabling the rotation-stopping lever 9 to cross the elongated portion acting as upper lever 10. As B-B' cross sectional view shown in FIG. 10, there are two rotation-stopping slots g symmetrically formed on the inner wall of a lever hole f in respective that are used for blocking the upper lever 10 for preventing rotation while only allowing the same to move up and down. There is a gap buffer 40 disposed between the upper lever 10 and the valve stem 18, which is slidably fitted inside the lever hole f for absorbing the bumping and noise between the two levers during operation.

Figure 11:
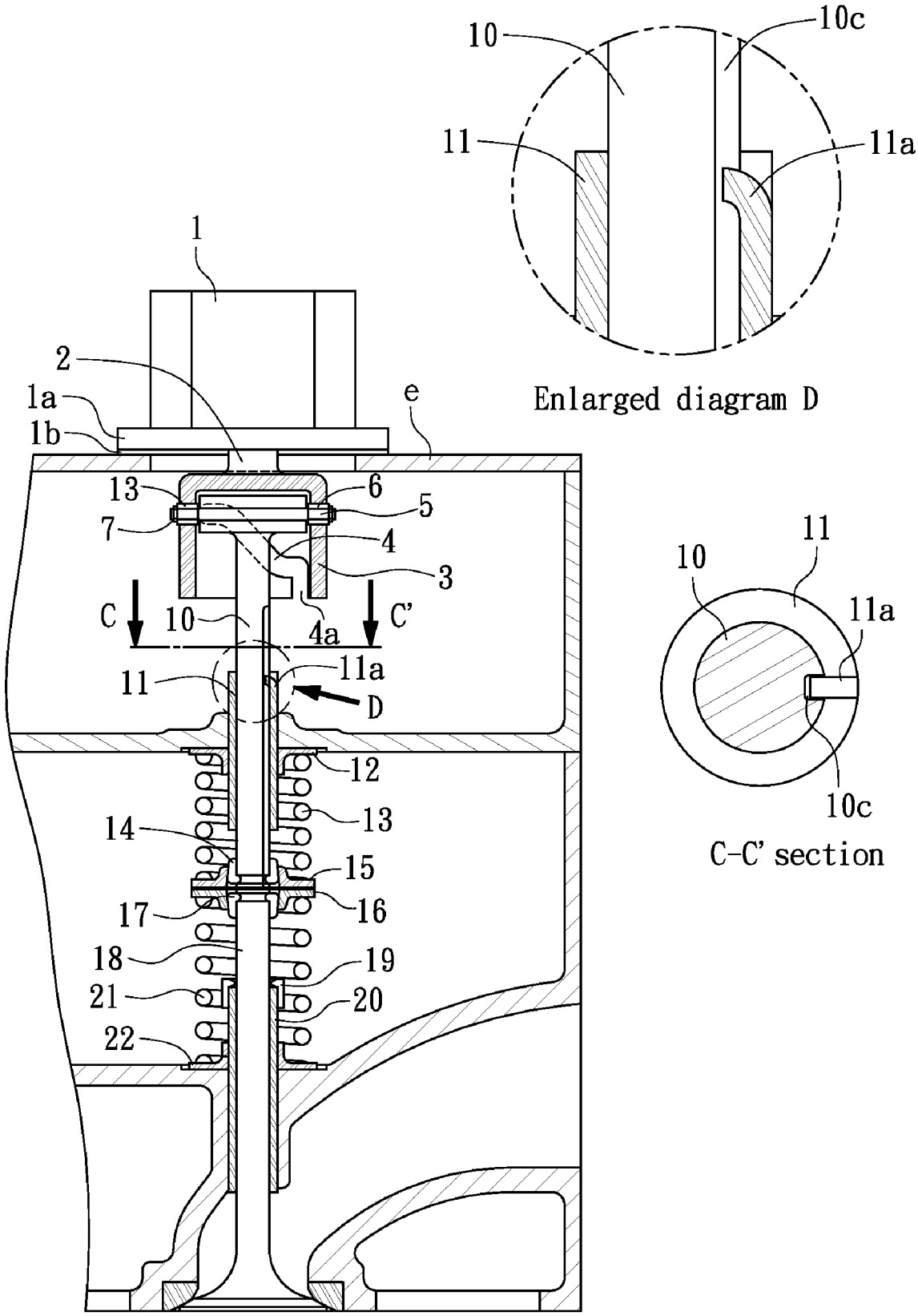
FIG. 11 is a sectional view of a valve in a multi-cam electric valve mechanism according to a sixth embodiment of the present invention as it is closed.

For facilitating the assembly, the cam 3 can be integrally formed with the motor shaft 2 while the integrated part can be disposed on the top portion of the mechanism; and the upper lever 10 can be integrally formed with the tappet seat 10*d* while mounting the rotor 6 of the tappet seat 10*d*, as the sixth embodiment shown in FIG. 11. In FIG. 11, the rotation of the cam 3 driven by the motor shaft 2 will cause the rotors 6 to be pressed by the walls of the corresponding grooves 4 that consequently only forces the upper lever 10 to move up and down but not rotate accordingly since the rotation-stopping slot formed on the upper lever 10 is inset by the rotation-stopping pin 11*a* in the lever guide 11 for working against and thus canceling out the rotation force component exerted on the upper lever 10 resulting from the compressed rotors 6. Moreover, the upper lever 10, the upper spring seat 12 and the upper spring 13 are tightly installed on the top portion d of the cylinder head a as an assembled part by the use of the snap key 14 and the spring fixing seat 15, while the valve stem 18, the lower spring 21 and the lower spring seat 22 are tightly installed on the cylinder head a as another assembled part by the use of the snap key 17 and the spring fixing seat 16. Then, the two assembled parts are assembled for preparing the same to be mounted on the cylinder cap e along with the motor so that the assembling of the mechanism is completed.

Figure 12:
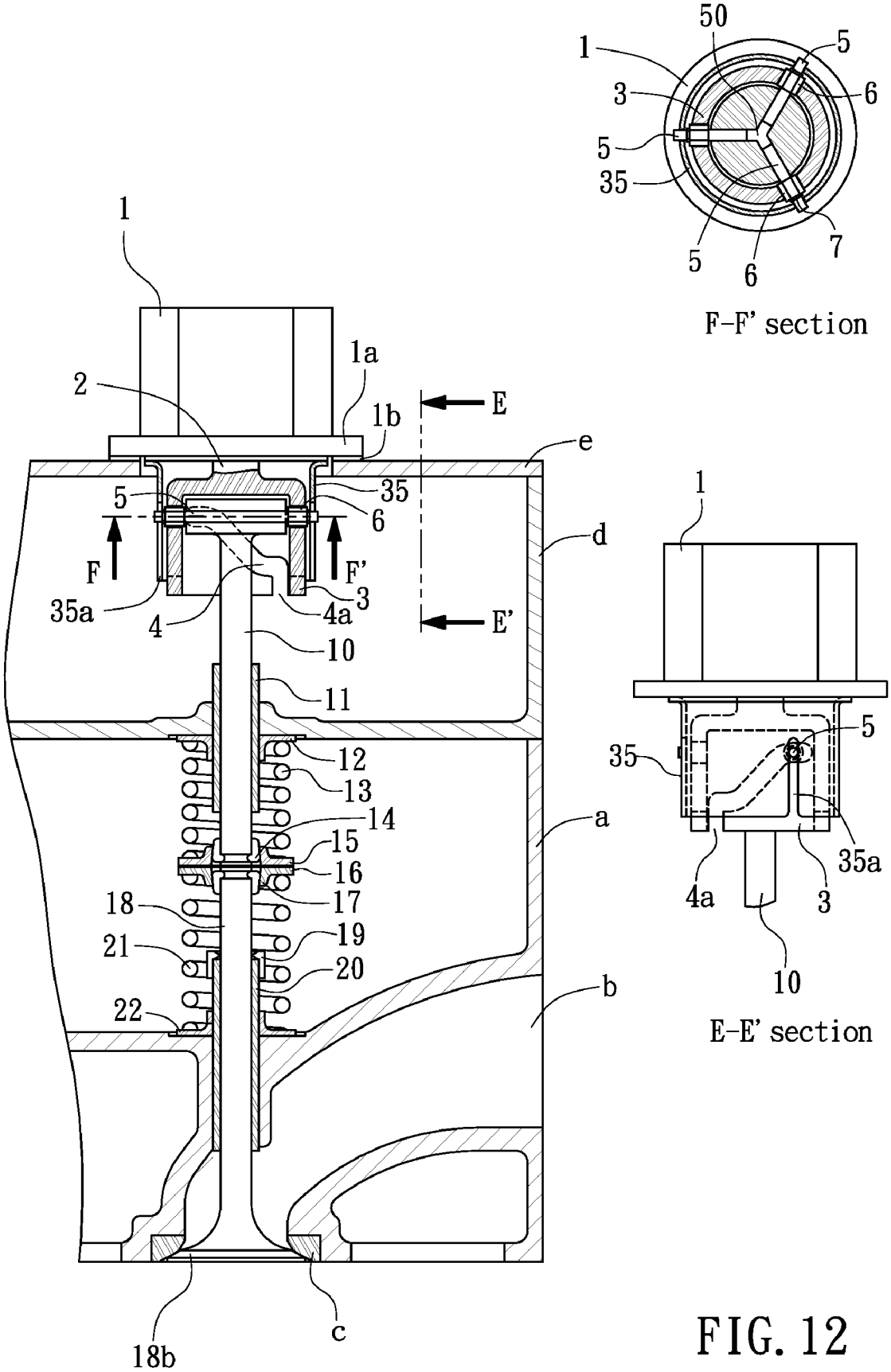
FIG. 12 is a sectional view of a valve in a multi-cam electric valve mechanism according to a seventh embodiment of the present invention as it is closed.

Please refer to FIG. 12, which is a sectional view of a valve in a multi-cam electric valve mechanism according to a seventh embodiment of the present invention as it is closed. The seventh embodiment is the modification of the sixth embodiment shown in FIG. 11. In the present embodiment, at the circumference of the cam 3 disposed under the motor 1, there is formed with a rotation-stopping ring 35 thereon; and on the rotation-stopping ring 35 at positions corresponding to the rotors 6, there are grooves symmetrically formed thereon to be used as the rotation-stopping slots 35*a*. Moreover, the tappet 5 of each rotor 6 is prolonged and is positioned to pass through the corresponding rotation-stopping slot 35*a*, as the F-F' sectional view and the E-E' sectional view shown in FIG. 12. Thereby, the rotation of the cam 3 driven by the motor shaft 2 will cause the rotors 6 to be pressed by the walls of the corresponding grooves 4 that consequently only forces the upper lever 10 to move up and down but not rotate accordingly since the tappet 5 of each rotor 6 is blocked by the rotation-stopping slot 35*a* and fixedly stuck inside the tappet hole 50 formed on the tappet seat 10*d* whereas the tappet seat 10*d* is further integrated with the upper lever 10. As the rotation-stopping ring 35 and the rotation-stopping slot 35*a* can be formed accurately in a comparatively simple manufacturing process, the cost of the present embodiment is reduced.

Figure 13:
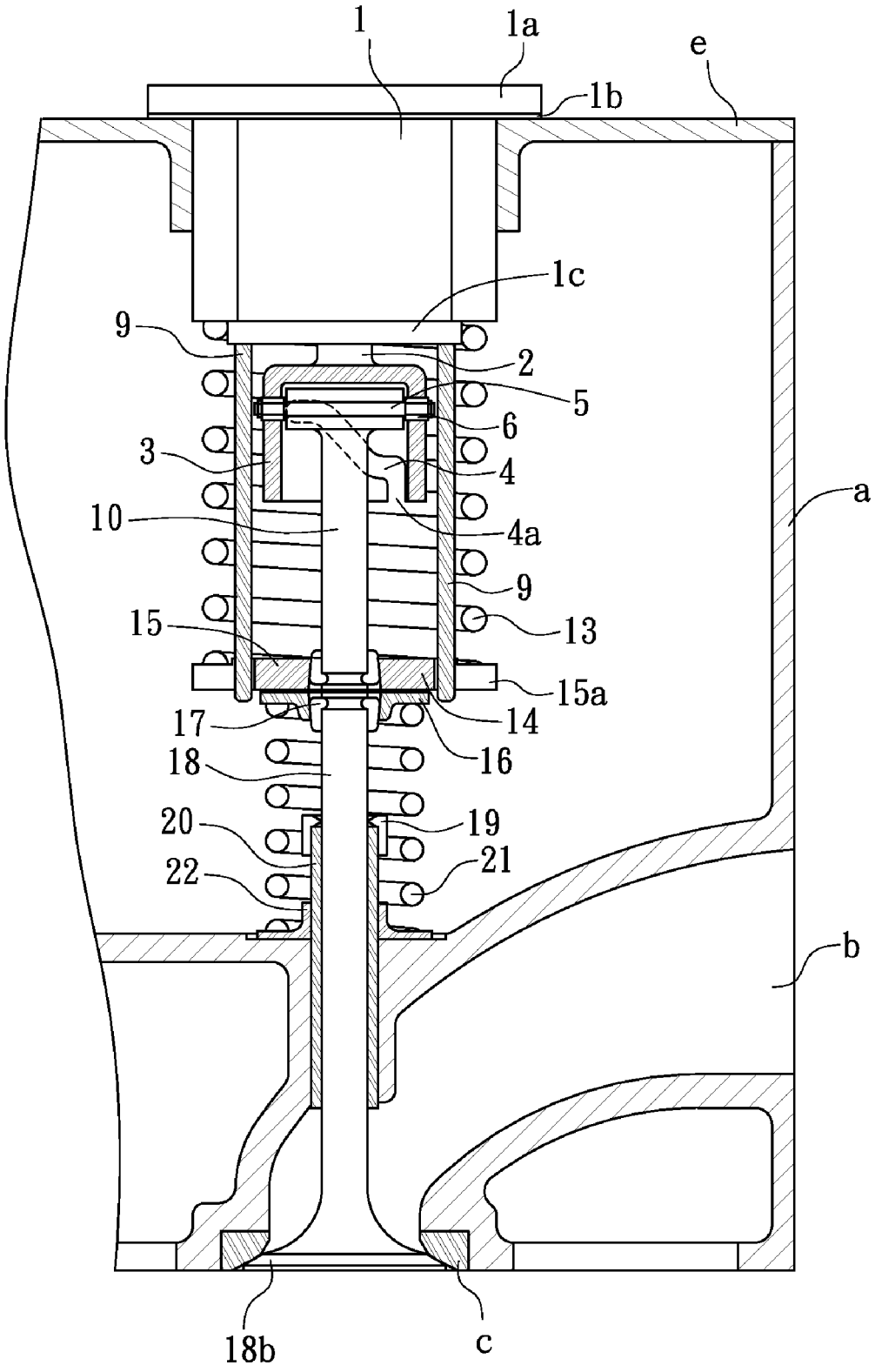
FIG. 13 is a sectional view of a valve in a multi-cam electric valve mechanism according to an eighth embodiment of the present invention as it is closed.

Please refer to FIG. 13, which is a sectional view of a valve in a multi-cam electric valve mechanism according to an eighth embodiment of the present invention as it is closed. The operation principle of the eighth embodiment is similar to that of the third embodiment. In order to prevent the cylinder head from being divided into two sections and the same time to minimize the amount of parts required for fabricating the cylinder while facilitating the assembly of the same, the multi-cam electric valve mechanism of the embodiment is deformed as well as extended. As shown in FIG. 13, there is a spring support 1*c* integrally formed at the bottom of the motor 1 that is used for replacing the function of the upper spring base 12. The structure of the top portion d of the cylinder head a in the first embodiment is omitted from the present embodiment. The cam 3 is mounted on the motor shaft 2 while the rotors 6, the upper lever 10 and the upper spring are tightly secured to the spring support 1*c* of the motor 1 by the spring fixing seat 15 and the snap key 14. The rotation-stopping lever 9 is fixed to the motor 1 in a manner that it can be inset into the rotation-stopping slot 15*a* formed on the spring fixing seat 15 so as to only allow the upper lever 10 to move up and down while preventing the same from rotating. Moreover, since the upper lever 10 is separated from the valve stem 18, during assembly, the upper lever 10, parts including the upper lever 10, the upper spring 13 and the motor, etc., can first be assembled into an assembled part, and then parts includes the valve stem 18, the low spring 21, etc., that are fixedly attached to the lower spring seat 22 by the spring fixing seat 16 and the snap key 17 is assembled with the cylinder head a to formed another assembled part, and then the two aforesaid assembled part can be combined to complete the assembly of the invention.

To sum up, it is noted that the operation of the multi-cam electric valve mechanism of the invention will not cause the valve lever to skew or even damage by regional friction as the sidewise push forces exerting on the valve lever resulting from the operation will cancel out each other. In addition, the valves being driven to close can tightly fit on the valve seats by the multi-cam electric valve mechanism of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A multi-cam electric valve mechanism for engine, comprising:

a motor, fixed on a cylinder;

a motor shaft, being connected to the motor by an end thereof for enabling the same to be driven to rotate accordingly while having a plurality of rotors being symmetrically distributed around another end thereof in a manner that the shaft of each rotor is oriented perpendicular to the motor shaft;

a ring-shaped cam, formed with a plurality of wave-shaped grooves on the circumference thereof at positions corresponding to the plural rotors for receiving the same;

a rotation-stopping lever, connected to the cylinder and the cam respectively for allowing the cam to move linearly along with the rotation-stopping lever; and a valve lever, having an end thereof connected to the cam and another end thereof connected to a valve.

2. The multi-cam electric valve mechanism of claim 1, wherein each rotor is fixed on an end of a tappet by a snap ring while allowing the same to rotate thereon; and the other end of the tappet is fixedly secured on a tappet seat as the tappet seat is connected to the motor shaft.

3. The multi-cam electric valve mechanism of claim 1, wherein the valve lever is composed of an upper lever and a valve stem that are interconnected with each other while the upper lever is connected to the cam and the valve stem is connected to the valve.

4. The multi-cam electric valve mechanism of claim 3, wherein the upper lever is ensheathed by an upper spring and the valve stem is ensheathed by a lower spring while the upper and the lower springs are configured to function opposite to each other.

5. The multi-cam electric valve mechanism of claim 1, wherein the cam is ensheathed by an upper spring and the valve lever is ensheathed by a lower spring while the upper and the lower springs are configured to function opposite to each other.

6. The multi-cam electric valve mechanism of claim 1, wherein the motor is engaged with the cylinder by a flange.

7. The multi-cam electric valve mechanism of claim 6, wherein there is an adjusting pad sandwiched between the flange and the cylinder.

8. The multi-cam electric valve mechanism of claim 1, further comprising:

a valve lever guide, shaped as a hollow ring connected to the cylinder to be used for receiving the valve lever therein so as to guide the valve lever to move linearly.

9. The multi-cam electric valve mechanism of claim 1, wherein the cam is configured with at least a rotation-stopping slot for receiving the rotation-stopping lever.

10. The multi-cam electric valve mechanism of claim 1, wherein the motor is a reciprocating motor.

11. A multi-cam electric valve mechanism for engine, comprising:

a motor, fixed on a cylinder;

a motor shaft, being connected to the motor by an end thereof for enabling the same to be driven to rotate accordingly while having a plurality of rotors being symmetrically distributed around another end thereof in a manner that the shaft of each rotor is oriented perpendicular to the motor shaft;

a ring-shaped cam, formed with a plurality of wave-shaped grooves on the circumference thereof at positions corresponding to the plural rotors for receiving the same;

a rotation-stopping lever, connected to the motor and the cam respectively for allowing the cam to move linearly along with the rotation-stopping lever; and a valve lever, having an end thereof connected to the cam and another end thereof connected to a valve.

12. The multi-cam electric valve mechanism of claim 11, wherein each rotor is fixed on an end of a tappet by a snap ring while allowing the same to rotate thereon; and the other end of the tappet is fixedly secured on a tappet seat as the tappet seat is connected to the motor shaft.

13. The multi-cam electric valve mechanism of claim 11, wherein the valve lever is composed of an upper lever and a valve stem that are interconnected with each other while the upper lever is connected to the cam and the valve stem is connected to the valve.

14. The multi-cam electric valve mechanism of claim 13, wherein the upper lever is ensheathed by an upper spring and the valve stem is ensheathed by a lower spring while the upper and the lower springs are configured to function opposite to each other.

15. The multi-cam electric valve mechanism of claim 11, wherein the motor is engaged with the cylinder by a flange.

16. The multi-cam electric valve mechanism of claim 15, wherein there is an adjusting pad sandwiched between the flange and the cylinder.

17. The multi-cam electric valve mechanism of claim 11, further comprising:

a valve lever guide, shaped as a hollow ring connected to the cylinder to be used for receiving the valve lever therein so as to guide the valve lever to move linearly.

18. The multi-cam electric valve mechanism of claim 11, wherein the cam is configured with at least a rotation-stopping slot for receiving the rotation-stopping lever.

19. The multi-cam electric valve mechanism of claim 11, wherein the motor is a reciprocating motor.

20. A multi-cam electric valve mechanism for engine, comprising:

a motor, fixed on a cylinder;

a ring-shaped cam, formed with a plurality of wave-shaped grooves on the circumference thereof while being connected to the motor by an end thereof for enabling the same to be driven to rotated thereby;

a plurality of rotors, each being receiving in its corresponding wave-shaped groove for allowing the same to rotate therein while having its shaft to be oriented perpendicular to a rotation shaft of the cam;

a rotation-stopping lever, fixed on the cylinder; and a valve lever, having a slip-stopping slot formed thereon for receiving the rotation-stopping lever while having its two ends to be connected to the rotors and a valve in respective.

21. The multi-cam electric valve mechanism of claim 20, wherein each rotor is fixed on an end of a tappet by a snap ring while allowing the same to rotate thereon; and the other end of the tappet is fixedly secured on a tappet seat as the tappet seat is connected to the valve lever.

22. The multi-cam electric valve mechanism of claim 20, wherein the valve lever is composed of an upper lever and a valve stem that are interconnected with each other while the upper lever is connected to the cam and the valve stem is connected to the valve.

23. The multi-cam electric valve mechanism of claim 22, wherein the upper lever is ensheathed by an upper spring and the valve stem is ensheathed by a lower spring while the upper and the lower springs are configured to function opposite to each other.

24. The multi-cam electric valve mechanism of claim 20, wherein the motor is engaged with the cylinder by a flange.

25. The multi-cam electric valve mechanism of claim 24, wherein there is an adjusting pad sandwiched between the flange and the cylinder.

26. The multi-cam electric valve mechanism of claim 20, further comprising:

a valve lever guide, shaped as a hollow ring connected to the cylinder to be used for receiving the valve lever therein so as to guide the valve lever to move linearly.

27. The multi-cam electric valve mechanism of claim 20, wherein the motor is a reciprocating motor.

28. A multi-cam electric valve mechanism for engine, comprising:

a motor, fixed on a cylinder;

a rotation-stopping lever, fixed on the cylinder;

a ring-shaped cam, formed with a plurality of wave-shaped grooves on the circumference thereof while being connected to the motor by an end thereof for enabling the same to be driven to rotated thereby;

a valve lever, having an end thereof connected to a valve; and a plurality of rotors, each having an end connected to the rotation-stopping lever and another end connected to the valve lever while being receiving in its corresponding wave-shaped groove for allowing the same to rotate therein and consequently move linearly along the rotation-stopping lever, each, and each being configured in a manner that the shaft thereof is oriented perpendicular to a rotation shaft of the cam.

29. The multi-cam electric valve mechanism of claim 28, wherein each rotor is fixed on an end of a tappet by a snap ring while allowing the same to rotate thereon; and an end of the tappet is fixed to the rotation-stopping slot for enabling the tappet to move linearly along the rotation-stopping lever while the other end of the tappet is fixedly secured on a tappet seat as the tappet seat is connected to the valve lever.

30. The multi-cam electric valve mechanism of claim 28, wherein the valve lever is composed of an upper lever and a valve stem that are interconnected with each other while the upper lever is connected to the rotors and the valve stem is connected to the valve.

31. The multi-cam electric valve mechanism of claim 30, wherein the upper lever is ensheathed by an upper spring and the valve stem is ensheathed by a lower spring while the upper and the lower springs are configured to function opposite to each other.

32. The multi-cam electric valve mechanism of claim 28, wherein the motor is engaged with the cylinder by a flange.

33. The multi-cam electric valve mechanism of claim 32, wherein there is an adjusting pad sandwiched between the flange and the cylinder.

34. The multi-cam electric valve mechanism of claim 28, further comprising:

a valve lever guide, shaped as a hollow ring connected to the cylinder to be used for receiving the valve lever therein so as to guide the valve lever to move linearly.

35. The multi-cam electric valve mechanism of claim 28, wherein the motor is a reciprocating motor.

* * * * *